US009109407B2

(12) United States Patent
Inglis et al.

(10) Patent No.: US 9,109,407 B2
(45) Date of Patent: Aug. 18, 2015

(54) UNEQUAL LOAD COLLET AND METHOD OF USE

(71) Applicant: Halliburton Energy Services, Inc., Houston, TX (US)

(72) Inventors: Peter Derek Walter Inglis, Dundee (GB); Mark John Milne, Arbroath (GB)

(73) Assignee: Halliburton Energy Services, Inc., Houston, TX (US)

( * ) Notice: Subject to any disclaimer, the term of this patent is extended or adjusted under 35 U.S.C. 154(b) by 270 days.

(21) Appl. No.: 13/718,828

(22) Filed: Dec. 18, 2012

(65) Prior Publication Data

US 2013/0161027 A1 Jun. 27, 2013

Related U.S. Application Data

(63) Continuation of application No. PCT/GB2011/001762, filed on Dec. 22, 2011.

(51) Int. Cl.

| | |
|---|---|
| ***B23B 31/20*** | (2006.01) |
| ***E21B 17/02*** | (2006.01) |
| ***E21B 17/04*** | (2006.01) |
| ***E21B 23/00*** | (2006.01) |
| ***E21B 41/00*** | (2006.01) |
| ***E21B 21/00*** | (2006.01) |

(52) U.S. Cl.

CPC ..... *E21B 17/02* (2013.01); *B23B 31/20* (2013.01); *E21B 17/04* (2013.01); *E21B 21/00* (2013.01); *E21B 23/00* (2013.01); *E21B 41/00* (2013.01); *Y10T 279/17316* (2015.01)

(58) Field of Classification Search

CPC ..... E21B 17/02; E21B 17/04; E21B 21/00; E21B 23/00; E21B 41/00; B23B 31/20; Y10T 279/17316

USPC ..... 166/381, 316, 179, 237, 192; 279/43.1

See application file for complete search history.

(56) References Cited

U.S. PATENT DOCUMENTS

| | | | |
|---|---|---|---|
| 3,335,802 | A | 8/1967 | Seyffert, III |
| 3,948,322 | A | 4/1976 | Baker |

FOREIGN PATENT DOCUMENTS

| | | | |
|---|---|---|---|
| GB | 2066326 | A | 7/1981 |
| WO | 2003029609 | A1 | 4/2003 |

OTHER PUBLICATIONS

Foreign communication from a related counterpart application—International Search Report and Written Opinion, PCT/GB2011/001762, Aug. 9, 2012, 11 pages.

*Primary Examiner* — Yong-Suk (Philip) Ro

(74) *Attorney, Agent, or Firm* — Scott Richardson; Baker Botts L.L.P.

(57) ABSTRACT

A downhole actuation system comprises an actuation mechanism comprising an indicator; a wellbore tubular; and a collet coupled to the wellbore tubular. The collet comprises a collet protrusion disposed on one or more collet springs, and the collet protrusion has a position on the one or more collet springs that is configured to provide a first longitudinal force to the indicator in a first direction and a second longitudinal force to the indicator in a second direction. The first longitudinal force is different than the second longitudinal force.

23 Claims, 10 Drawing Sheets

UNEQUAL LOAD COLLET AND METHOD OF USE

CROSS-REFERENCE TO RELATED APPLICATIONS

This application is a continuation of and claims priority to International Application No. PCT/GB2011/001762 filed Dec. 22, 2011 and entitled "Unequal Load Collet and Method of Use," which application is incorporated by reference herein in its entirety.

BACKGROUND

During drilling and upon completion and production of an oil and/or gas wellbore, a workover and/or completion tubular string can be installed in the wellbore to allow for production of oil and/or gas from the well. Current trends involve the production of oil and/or gas from deeper wellbores with more hostile operating environments. Various downhole tools may be installed within the wellbore, rather than at the surface of the wellbore, to provide operational control in deep wells. These remote tools can be activated within a wellbore based on control line signals, hydraulic actuation mechanism, and/or mechanical actuation mechanism. When a mechanically actuated mechanism is used to activate or deactivated a downhole tool, the mechanical force is typically supplied by a tubular string deployed within the wellbore. As the depth of the downhole tool increases, the mechanical force required to actuate to the downhole tool may increase in order to overcome various losses within the wellbore, such as friction along the length of the wellbore between the surface and the downhole tool actuation mechanism. As a result, the force placed on the wellbore tubular can be high. This additional force imposes stresses and strains on the wellbore tubular that may be limited by the operational thresholds of the wellbore tubular itself.

SUMMARY

According to an embodiment, a downhole actuation system comprises an actuation mechanism comprising an indicator; a wellbore tubular; and a collet coupled to the wellbore tubular. The collet comprises a collet protrusion disposed on one or more collet springs, and the collet protrusion has a position on the one or more collet springs that is configured to provide a first longitudinal force to the indicator in a first direction and a second longitudinal force to the indicator in a second direction. The first longitudinal force is different than the second longitudinal force. The wellbore tubular may comprise a drill pipe, a casing, a liner, a jointed tubing, a coiled tubing, or any combination thereof. A ratio of the second longitudinal force to the first longitudinal force may be greater than about 1.1. The first longitudinal force may be in the range of from about 1,000 pounds-force to about 10,000 pounds-force, and the second longitudinal force may be in the range of from about 2,000 pounds-force to about 20,000 pounds-force. The first longitudinal force may be less than a compressive load limit of the wellbore tubular. The second longitudinal force may be less than a tensile load limit of the wellbore tubular. The downhole actuation system may also include a downhole tool coupled to the actuation mechanism, where the actuation mechanism may be configured to produce a movement in the downhole tool through a translation of one or more components of the actuation mechanism. The downhole tool may comprise a device selected from: a plug, a valve, a lubricator valve, a tubing retrievable safety valve, a fluid loss valve, a flow control device, a zonal isolation device, a sampling device, a portion of a drilling completion, a portion of a completion assembly, or any combination thereof.

According to an embodiment, a collet comprises a collet spring; and a collet protrusion disposed on the collet spring. The collet protrusion comprises a first engagement surface and a second engagement surface, and a first distance between the first engagement surface and a center point of the collet spring is less than a second distance between the second engagement surface and the center point of the spring. The collet may also include a plurality of collet springs and a plurality of slots disposed between adjacent collet springs, wherein the plurality of collet springs couples a first end to a second end. The first end or the second end may comprise a tapered guide. The center point of the collet spring may comprise a center of the collet spring or a load center point of the collet spring. The first engagement surface may be located at about the center point of the collet spring. The second distance may be at least about 10% of an overall length of the collet spring. When neither the first distance nor the second distance is zero, a ratio of the second distance to the first distance may be greater than about 1.05. The collet protrusion may be disposed on an inner surface of the collet spring and/or the collet protrusion may be disposed on an outer surface of the collet spring.

According to an embodiment, a method of actuating a downhole tool comprises providing a collet coupled to a wellbore tubular, wherein the collet comprises a collet protrusion disposed on a collet spring; providing a first longitudinal force to an actuation mechanism in a first direction using the collet; and providing a second longitudinal force to the actuation mechanism in a second direction using the collet, wherein the first longitudinal force is different that the second longitudinal force, and wherein the first longitudinal force and the second longitudinal force are provided as a result of the configuration of the placement of the collet protrusion on the collet spring. The actuation mechanism may be configured to actuate a downhole tool to a first position in response to the first longitudinal force in the first direction, and the actuation mechanism may be further configured to actuate the downhole tool to a second position in response to second longitudinal force in the second direction. Providing the first longitudinal force may comprise engaging a first surface of the collet protrusion with an indicator coupled to the actuation mechanism. The method may also comprise passing the collet by the actuation mechanism in response to the first longitudinal force or the second longitudinal force exceeding a threshold. Passing the collet by the actuation mechanism may comprise applying a radial force to the collet protrusion at the first surface; radially displacing the collet spring through an interference distance; and conveying the collet past the indicator.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
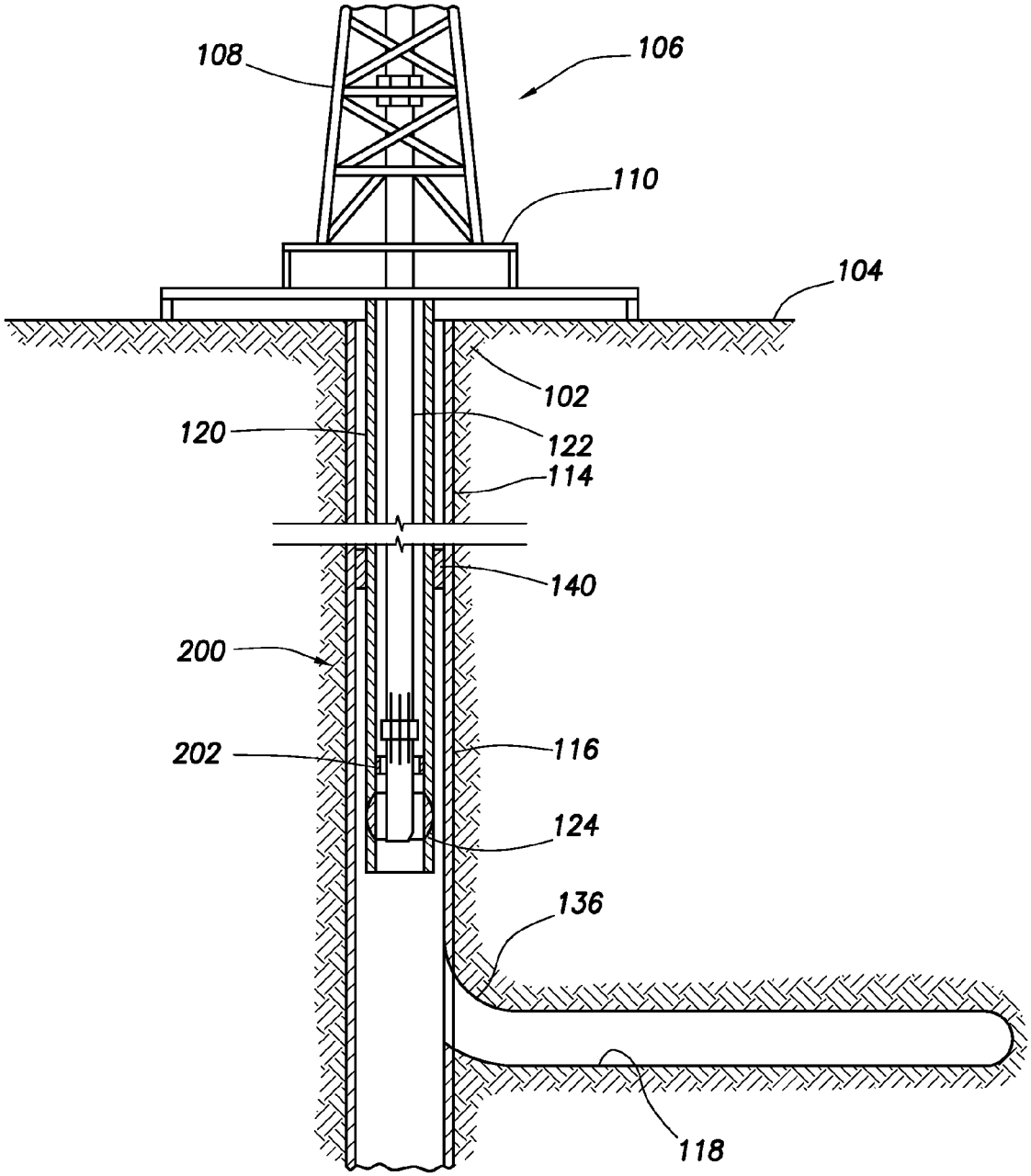
FIG. 1 is a schematic view of an embodiment of a subterranean formation and wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. As used herein, a "compressive load" on a wellbore tubular refers to a load in a downward direction that acts to compress a wellbore tubular. As used herein, a "tensile load" on a wellbore tubular refers to a load in an upward direction that act to place a wellbore tubular in tension. Reference to a longitudinal force means a force substantially aligned with the direction of the longitudinal axis of the wellbore, and reference to a radial force means a force substantially aligned with the radial direction of the wellbore (i.e., a direction substantially normal to the longitudinal axis). The various characteristics mentioned above, as well as other features and characteristics described in more detail below, will be readily apparent to those skilled in the art with the aid of this disclosure upon reading the following detailed description of the embodiments, and by referring to the accompanying drawings.

Disclose herein are devices, systems, and methods for actuating an actuation mechanism using a unequal load collet, which may be configured to provide one force to actuate a device in a first direction and a different force to actuate the device in a second direction. Referring to FIG. 1, an example of a wellbore operating environment in which a collet 200 and actuation mechanism 202 may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells.

A wellbore tubular string 120 and/or a wellbore tubular string 122 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string disposed in the wellbore 114, and a second wellbore tubular 122 is illustrated in the form of a wellbore tubular disposed within the wellbore tubular 120. It should be understood that the wellbore tubular 120 and/or the second wellbore tubular 122 is equally applicable to any type of wellbore tubulars being inserted into a wellbore including as non-limiting examples drill pipe, casing, liners, jointed tubing, and/or coiled tubing. Further, the wellbore tubular 120 and/or the second wellbore tubular 122 may operate in any of the wellbore orientations (e.g., vertical, deviated, horizontal, and/or curved) and/or types described herein. In an embodiment, the wellbore may comprise wellbore casing, which may be cemented into place in the wellbore 114. In general, the wellbore tubular 120 and/or the second wellbore tubular 122 may have a different tensile load limit than a compressive load limit. For example, coiled tubing may be subject to buckling when placed under a given compressive load while being capable of supporting the same load in tension. In an embodiment, the unequal load collet may allow a downhole tool to be actuated using a force in each direction that is within the compressive load limit and the tensile load limit of the wellbore tubular 120 and/or the second wellbore tubular 122 used to form the wellbore tubular string. This represents an advantage over previous actuation devices that require the same force in each direction, as one or more of the forces may exceed the tensile load limit and/or the compressive load limit of the wellbore tubular used.

In an embodiment, the wellbore tubular string 120 may comprise a completion assembly string comprising one or more wellbore tubular types and one or more downhole tools (e.g., zonal isolation devices 140, screens, valves 124, etc.), including in an embodiment, one or more actuation mechanisms 202. In an embodiment, the second wellbore tubular string 122 may be disposed within the wellbore tubular string 120 to actuate one or more downhole tools forming a portion of the wellbore tubular string 120. The second wellbore tubular string 122 may comprise the collet 200 for engaging and actuating the one or more actuation mechanisms 202. The one or more downhole tools may take various forms. For example, a zonal isolation device may be used to isolate the various zones within a wellbore 114 and may include, but is not limited to, a plug, a valve 124 (e.g., lubricator valve, tubing retrievable safety valve, fluid loss valves, etc.), and/or a packer 140 (e.g., production packer, gravel pack packer, frac-pac packer, etc.).

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for extending the wellbore tubular 120 and/or the second wellbore tubular 122 into the wellbore 114 to position the wellbore tubular 120 and/or the second wellbore tubular 122 at a selected depth. While the operating environment depicted in FIG. 1 refers to a stationary workover and/or drilling rig 106 for conveying the wellbore tubular 120 and/or the second wellbore tubular 122 comprising the collet 200 within a land-based wellbore 114, in alternative embodiments, mobile workover rigs, wellbore servicing units (such as coiled tubing units), and the like may be used to lower the outer wellbore tubular 120 and/or the second wellbore tubular comprising the collet 200 into the wellbore 114. It should be understood that a wellbore tubular 120 and/or a second wellbore tubular 122 may alternatively be used in other operational environments, such as within an offshore wellbore operational environment.

Regardless of the type of operational environment in which the collet 200 and actuation mechanism 202 are used, it will be appreciated that collet 200 and actuation mechanism 202 serve to actuate a downhole device using one force in a first direction and a different force in a second direction. For example, the collet 200 and an actuation mechanism 202 may be used to open a downhole valve 124 using a first force (e.g., a first longitudinal force) and then close the valve 124 using a second force (e.g., a second longitudinal force) in a second direction, where the second force may be greater than the first force and the second direction may be different than the first direction. As described in greater detail with reference to FIGS. 2A, 2B, and 3, the collet 200 comprises a first end 208, a second end 210, a plurality of collet springs 204 with a plurality of slots 212 disposed there between, and a collet protrusion 206. The collet protrusion 206 may engage an indicator 304 on the actuation mechanism 202 and apply a longitudinal force to the indicator 304 to actuate the downhole tool or device. The actuation mechanism 202 may comprise a portion of the downhole tool or device configured to be operated through an engagement with the collet 200 and/or a separate component from the downhole tool or device that is coupled to and configured to actuate the downhole tool or device.

Figure 2A:
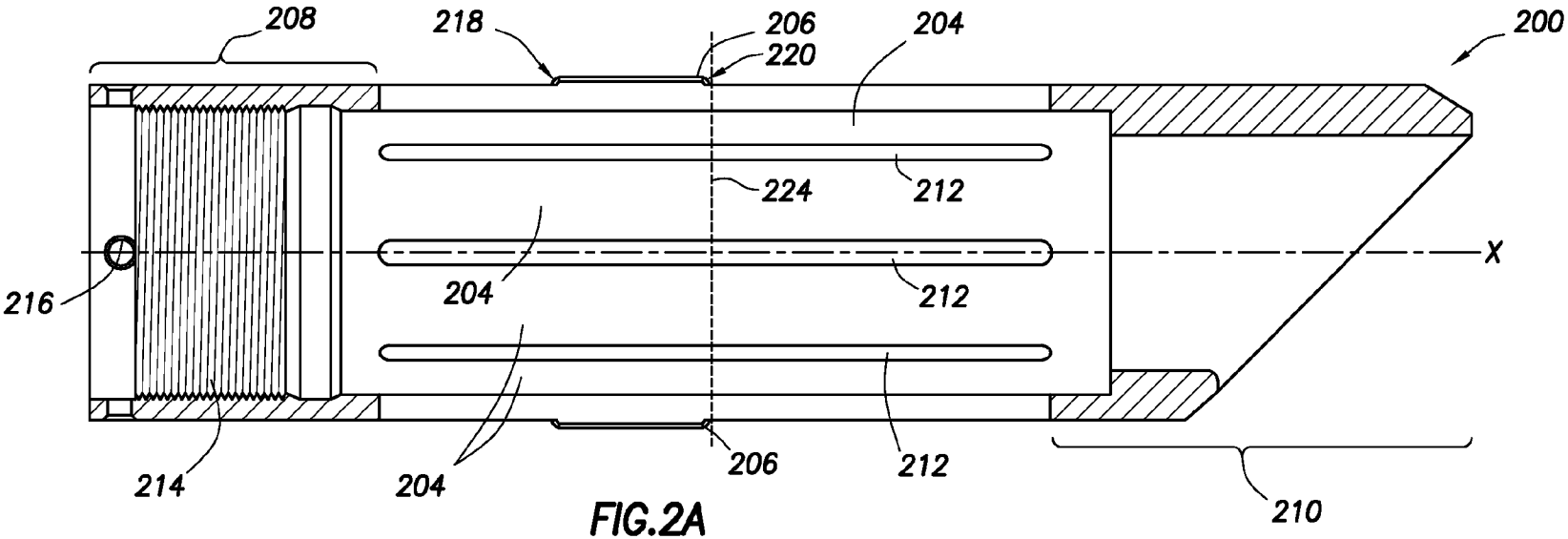
FIG. 2A is a cross-sectional view of a collet accordingly to an embodiment.
Figure 2B:
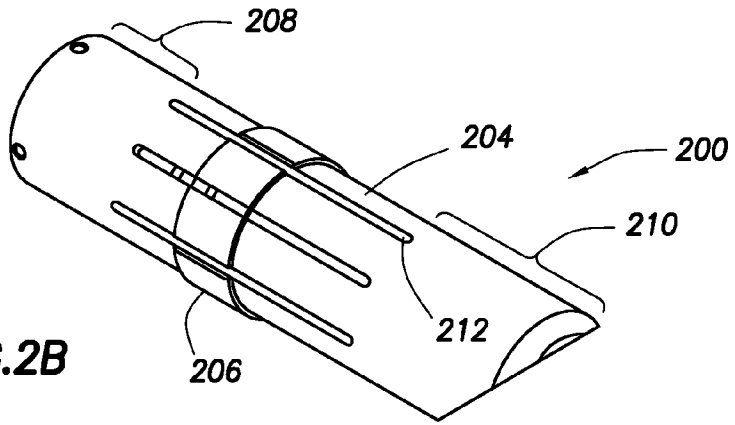
FIG. 2B is an isometric view of a collet accordingly to an embodiment.

An embodiment of the collet 200 is shown in FIGS. 2A and 2B in the configuration in which it may be conveyed into the wellbore 114. The first end 208 of the collet 200 generally comprises a tubular mandrel or means. The outer diameter of the first end 208 may be sized to allow the collet 200 to be conveyed within the wellbore and/or within one or more wellbore tubulars disposed within the wellbore. A longitudinal fluid passage 214 extends through the first end 208 to allow for the passage of fluids and/or other components (e.g., one or more additional wellbore tubulars) through the collet 200. The first end 208 of the collet 200 may be coupled to a wellbore tubular by any known connection means. In an embodiment, the collet 200 may be coupled to a wellbore tubular by a threaded connection formed between the wellbore tubular and the first end 208. In other embodiments, the first end 208 of the collet 200 may be coupled to a wellbore tubular through the use of one or more connection mechanisms such as a screw (e.g., a set screw), a bolt, a pin, a weld, and/or the like. In an embodiment, one or more screws (e.g., set screws) may be disposed in one or more holes 216, which may comprise corresponding threads, in the first end 208 of the collet 200 to couple the collet 200 to a wellbore tubular 120.

In an embodiment, the second end 210 of the collet 200 may also generally comprise a tubular mandrel or means. The outer diameter of the second end 210 may be sized to allow the collet 200 to be conveyed within the wellbore and/or within one or more wellbore tubulars disposed within the wellbore. The longitudinal fluid passage 214 extends from the first end 208 through the second end 210 to allow for the passage of fluids and/or other components (e.g., one or more additional wellbore tubulars) through the collet 200. The second end 210 of the collet 200 may be coupled to a wellbore tubular by any known connection means. In an embodiment, the second end 210 of the collet 200 may be coupled to a wellbore tubular by a threaded connection formed between the wellbore tubular and the second end 210. In other embodiments, the second end 210 of the collet 200 may be coupled to a wellbore tubular through the use of one or more connection mechanisms such as a screw, a bolt, a pin, a set screw, a weld, and/or the like. In some embodiments, the second end 210 of the collet 200 may not be coupled to a wellbore tubular. Rather, the second end 210 may be configured to form a guide to aid in directing the collet 200 and the wellbore tubular 120 coupled to the collet 200 through the interior of the wellbore and/or a wellbore tubular. In an embodiment, the second end 210 may form a tapered guide (e.g., a mule shoe guide) with an end disposed at a non-normal angle to the longitudinal axis (i.e., axis X of FIG. 2A) of the wellbore. In an embodiment, the second end 210 may not form a guide, but the second end 210 may be coupled to a guide using a threaded connection and/or another connection mechanism. In still other embodiments, the second end 210 may not form a guide or be coupled to a guide.

Figure 6A:
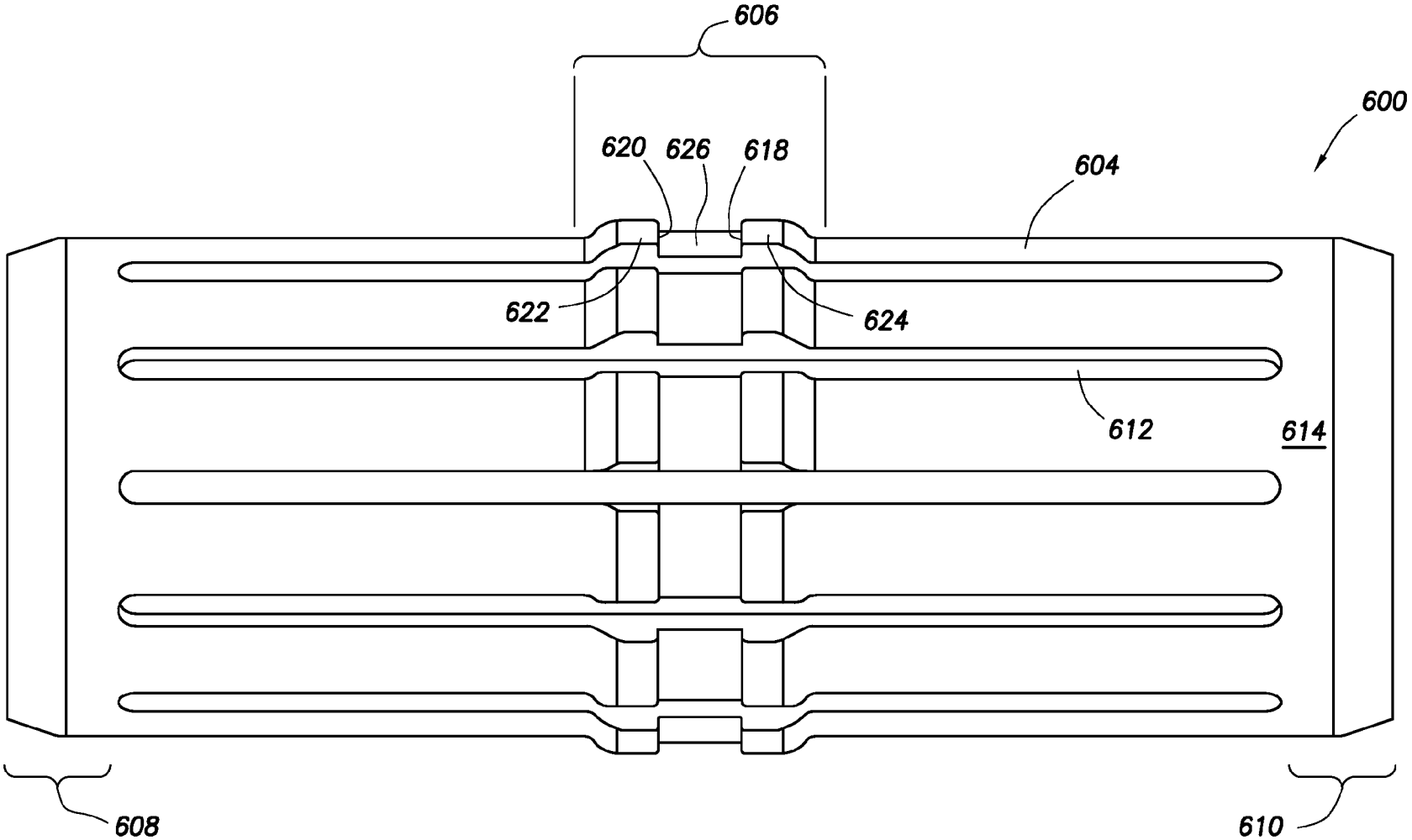
FIG. 6A is still another cross-sectional view of a collet accordingly to still another embodiment.
Figure 6B:
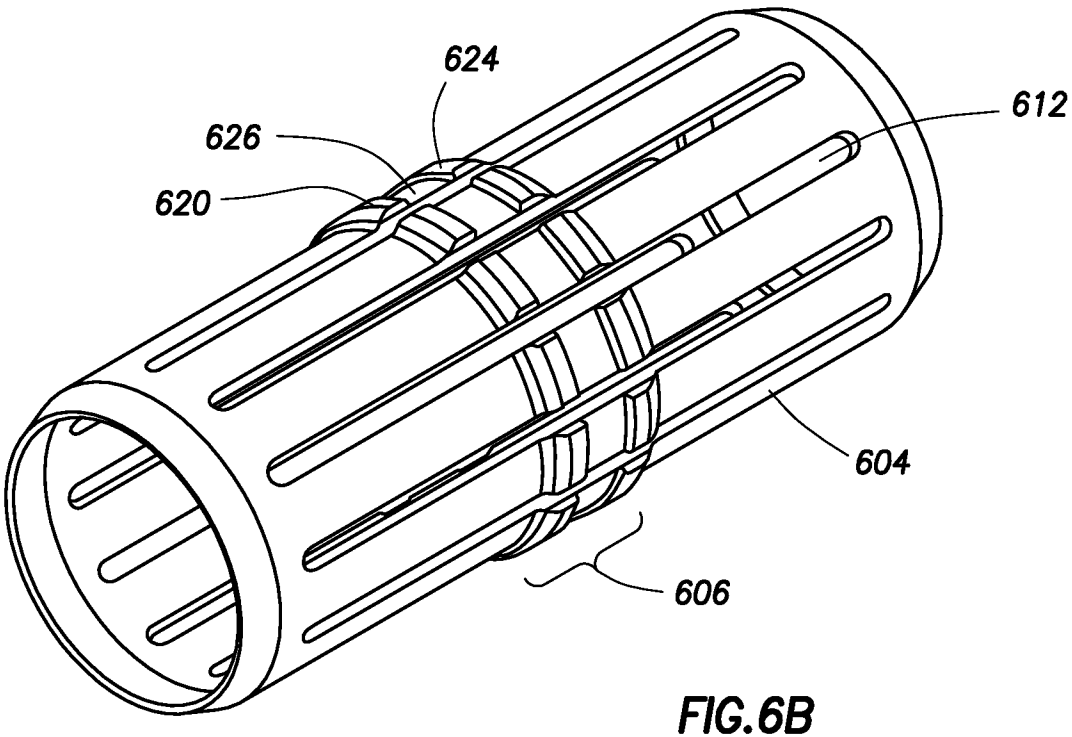
FIG. 6B is another isometric view of a collet accordingly to still another embodiment.
Figure 6C:
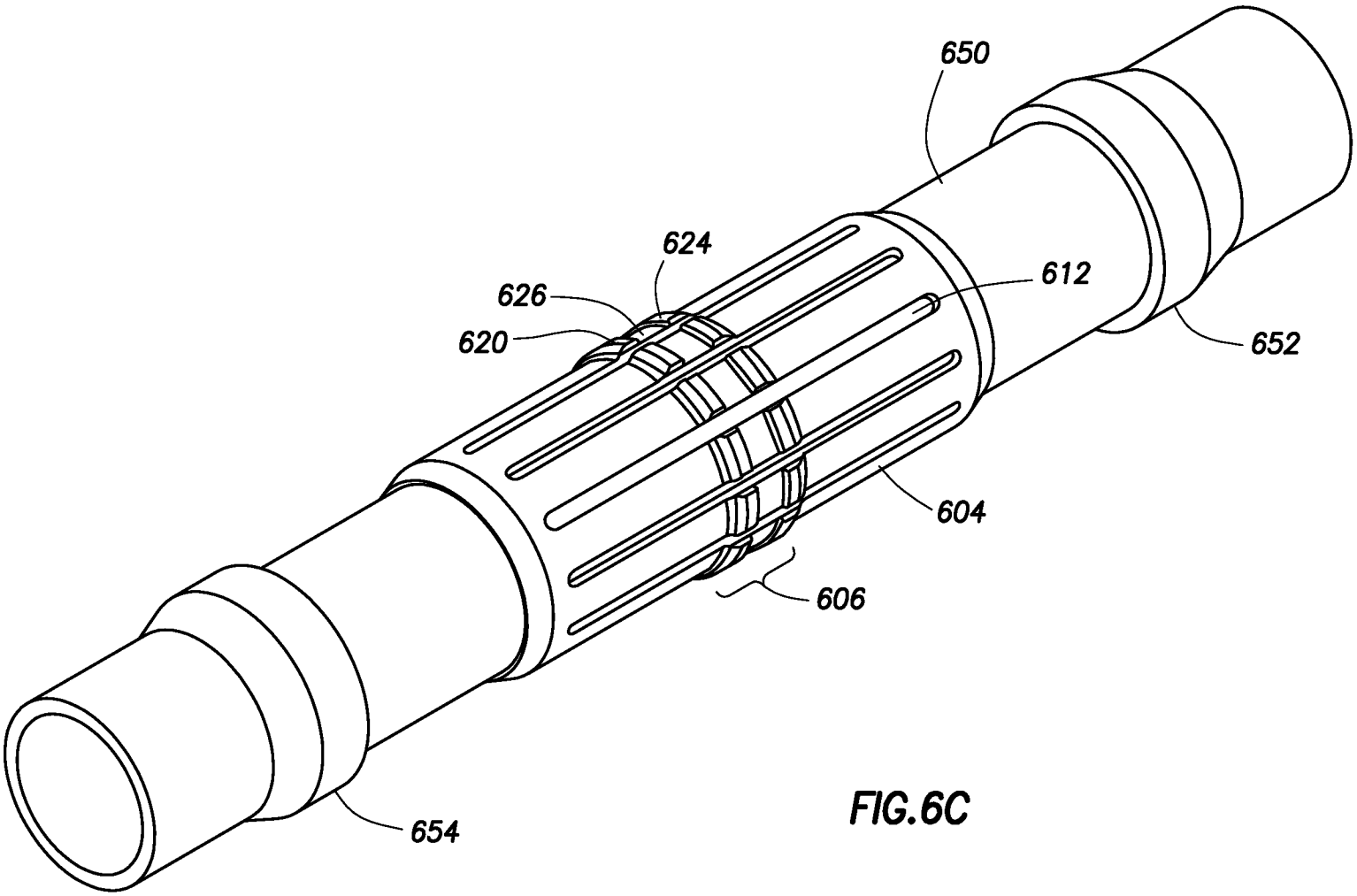
FIG. 6C is still another isometric view of a collet accordingly to still another embodiment.
Figure 7:
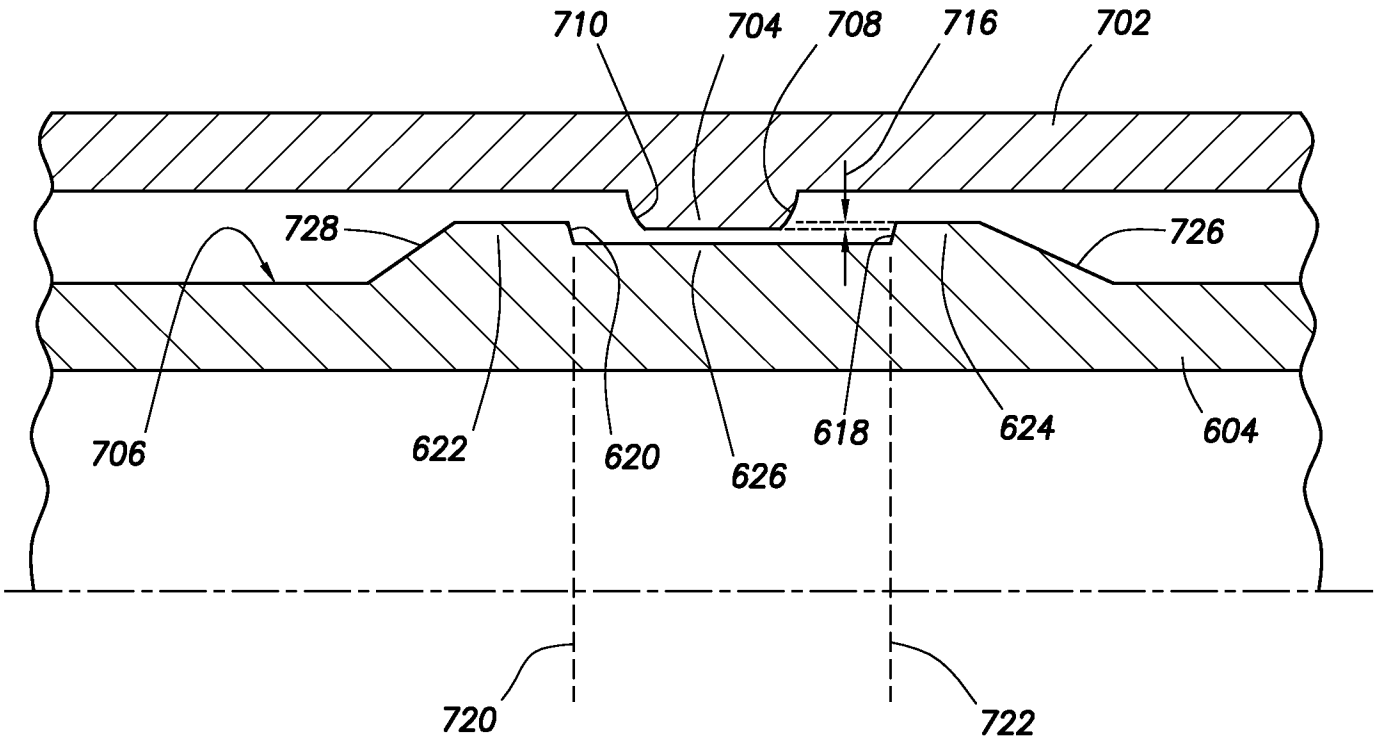
FIG. 7 is still another cross-sectional view of a collet and a wellbore tubular accordingly to still another embodiment.

In an embodiment as shown in FIG. 6C (described in more detail herein), the collet 200 may be disposed about a mandrel 650. The mandrel 650 may pass through the first end 208 and the second end 210 through the longitudinal fluid passageway 214. The diameter and configuration of the mandrel 650 may allow for radial compression and/or expansion of the collet 200 due to an interaction with an indicator. One or more features 652, 654 may engage the first end 208 and/or the second end 210 to maintain the collet 200 in position on the mandrel 650. For example, one or more collars (e.g., stop collars) may be disposed above and/or below the collet 200 to limit the relative longitudinal movement of the collet 200 about the mandrel 650. In this configuration, the collet 200 may be slidingly engaged with the mandrel 650. In an embodiment, the mandrel 650 may be a separate component coupled to the wellbore tubular 120 and/or the second wellbore tubular 122, or alternatively, the mandrel may comprise a portion of the wellbore tubular 120 and/or the second wellbore tubular 122. Various other configurations are possible for conveying the collet 200 within the wellbore on a wellbore tubular and/or as part of a wellbore tubular string.

Figure 3:
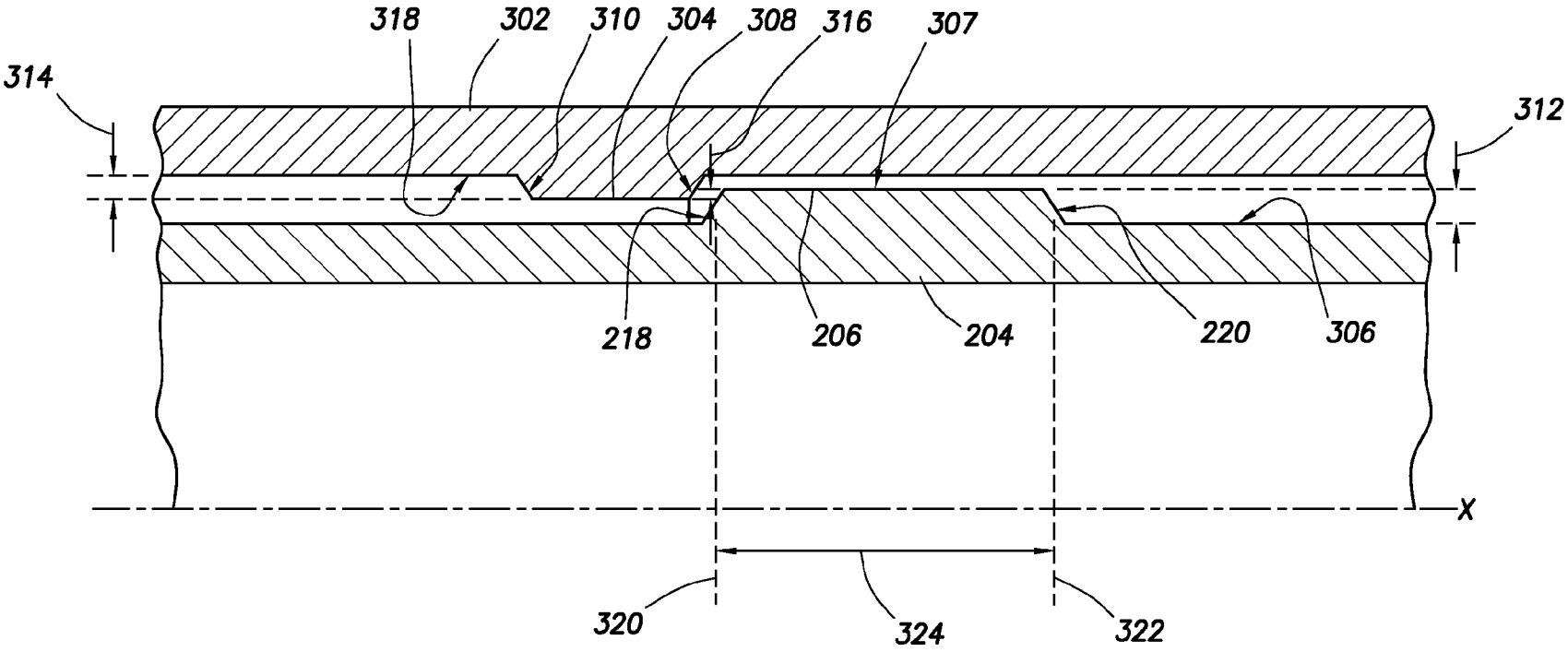
FIG. 3 is a cross-sectional view of a collet and a wellbore tubular accordingly to an embodiment.

Returning to the embodiment shown in FIGS. 2A, 2B, and 3, the collet 200 comprises one or more springs 204 (e.g., beam springs) and/or spring means separated by slots 212. In some contexts, the springs 204 may be referred to as collet fingers 204. The springs 204 couple the first end 208 of the collet 200 to the second end 210 of the collet 200. The springs 204 may be configured to form a generally cylindrical configuration about the longitudinal fluid passage 214, which may result from cutting the slots 212 from a single cylindrical mandrel to form the first end 208, the one or more springs 204 and the second end 210.

The one or more springs 204 may be configured to allow for a limited amount of radial compression of the springs 204 in response to a radially compressive force, and/or a limited amount of radial expansion of the springs 204 in response to a radially expansive force. The radial compression and/or expansion may allow the collet and the collet protrusion 206 to pass by a restriction in a wellbore and/or in a wellbore tubular while returning to the original diameter once the collet has moved past the restriction. The amount of radial expansion and/or compression may depend on various factors including, but not limited to, the properties of the springs 204 (e.g., geometry, length, cross section, moments, etc.), the radial force applied, and/or the material used to form the springs 204. In addition to these factors, the force required to produce a given amount of radial expansion and/or contraction depends on the location of the applied force along the length of the spring 204. For a spring of constant cross section, the greatest radial expansion and/or compression for a given force generally occurs when the force is applied at the center of the spring (e.g., the location approximately half way between a first end of the spring 204 adjacent the first end 208 of the collet 200 and a second end of the spring 204 adjacent the second end 210 of the collet 200). As the applied force moves away from the center point of the spring, the amount of radial expansion and/or contraction decreases by an amount generally predictable using a variety of known techniques such as beam theory, where the spring is modeled as a beam. This concept may be restated in terms of the force required to provide a given amount of radial expansion and/or compression. In general, the force required to produce a given amount of radial expansion and/or contraction is the least when the amount of expansion and/or contraction is generated at the center point of the spring, and the force required to produce the given amount of radial expansion and/or contraction increases as the point of expansion and/or contraction moves away from the center point of the spring.

For springs having a non-constant cross section, beam theory may be used to predict and/or determine the point on the spring requiring the least amount of radial force to produce a given amount of radial expansion and/or contraction. This point may be referred to herein as the load center point, which may correspond to the center of the spring for a spring of constant cross section and may vary from the center of the spring for springs having non-constant cross sections. The force required to produce a given amount of radial expansion and/or contraction may increases as the point of expansion and/or contraction moves away from the load center point. These concepts may be used to design the collet protrusion 206 as described in more detail herein.

In an embodiment, the collet 200 comprises one or more cuts forming slots 212 between the plurality of springs 204. The slots 212 may allow the collet protrusion 206 to at least partially compress inward (i.e., radially compress) in response to a radially compressive force and/or at least partially expand outwards (i.e., radially expand) in response to a radially expansive force, as described in more detail below. In an embodiment, the slots 212 may comprise longitudinal slots, angled slots (as measured with respect to the longitudinal axis X), helical slots, and/or spiral slots for allowing at least some radial compression in response to a radially compressive force. The configuration of the slots 212 (e.g., their shape, width, length, orientation, and/or dimensions relative to the dimensions of the springs) may be designed to determine the spring characteristics of the springs 204 and the corresponding configuration and properties of the collet protrusion 206.

The collet 200 also comprises a collet protrusion 206 disposed on the outer surface of one or more of the plurality of springs 204. In an embodiment, the collet protrusion 206 may be disposed on only one of the springs 204, a portion of the plurality of springs 204, or all of the springs 204. The collet protrusion 206 is configured to engage an indicator 304 and thereby produce a longitudinal force (i.e., a force substantially parallel to the axis X) on the indicator 304 and a radial force (e.g., a radially compressive force and/or a radially expansive force) on the springs 204. In an embodiment, the collet protrusion 206 may be configured to engage the indicator 304 at a plurality of surfaces or points and thereby produce the corresponding longitudinal and radial forces at a plurality of points along the length of the springs 204. The configuration of the collet protrusion 206 may be used to determine the force required to move the collet 200 past the indicator 304 in each direction, as described in more detail herein.

As shown in FIGS. 2A, 2B, and 3, the collet protrusion 206 generally comprises a section of the springs 204 with an increased outer diameter. The one or more collet protrusions 206 on the one or more springs 204 may extend around the outer surface of the springs 204, and as part of the springs 204, the one or more slots 212 may extend between adjacent collet protrusions 206. The collet protrusion 206 may comprise one or more surfaces 218, 220 for engaging and/or contacting the indicator 304 disposed on an outer wellbore tubular 302 and/or a component thereof such as a downhole tool or actuation mechanism 202. In some contexts, the surfaces 218, 220 may be referred to as engaging surfaces 218, 220. In an embodiment, the surfaces 218, 220 may be disposed at generally obtuse angles with respect to the angle between the outer surface 306 of the springs 204 and the surfaces 218, 220 as measured in a longitudinal direction (i.e., along axis X). This angle may allow for a radially compressive force to be applied to the springs 204 when the collet protrusion 206 contacts the corresponding indicator 304 on the outer wellbore tubular 302. In an embodiment, the angle between outer surface 306 of the springs 204 and the surfaces 218, 220 may be greater than 90 degrees and less than 180 degrees. In an embodiment, the angle between the outer surface 306 of the springs 204 and the surfaces 218, 220 may be about 100 degrees, about 110 degrees, about 120 degrees, about 130 degrees, about 135 degrees, about 140 degrees, about 150 degrees, about 160 degrees, or about 170 degrees. The angle between the outer surface 306 of the springs 204 and the surface 218 may be the same or different than the angle between the outer surface 306 of the springs 204 and the surface 220. In some embodiments, more than two surfaces may be present on one or more collet protrusions 206. In this embodiment, each of the surfaces may have the same or different angles between the outer surface 306 of the springs 204 and the corresponding surface. In an embodiment, the edges formed between the surfaces 218, 220 and the outer surface of the collet protrusion 206 may be rounded or otherwise beveled to aid in the movement of the collet protrusion 206 past the indicator 304.

The indicator 304 is coupled to a wellbore tubular 302 and/or as a part of a downhole tool or actuation mechanism. The indicator 304 is configured to engage the collet protrusion 206 to produce the longitudinal and radial forces at one or more points along the springs 204. The indicator 304 and the wellbore tubular 302 are generally configured to resist radial movement and may be configured to withstand greater radial compressive and/or radial compressive loads than the springs 204 of the collet 200. The downhole tool and/or actuation mechanism may be configured to allow for an amount of longitudinal translation in response to an applied longitudinal force resulting from the engagement of the collet 200 and the indicator 304. As a result, the engagement between the collet protrusion 206 and the indicator 304 may produce an amount of longitudinal translation of the indicator 304 and/or the actuation mechanism followed by a radial expansion and/or a radial compression of the springs 204 to allow the collet 200 to pass by the indicator 304.

In an embodiment, the indicator 304 generally comprises a section of the wellbore tubular 302 and/or a component thereof with a decreased inner diameter. In other embodiments as described in more detail below, the indicator 304 comprises a section of the wellbore tubular 302 and/or a component thereof with an increased outer diameter and the collet may pass outside the wellbore tubular. The indicator 304 may comprise one or more surfaces 308, 310 for contacting the surfaces 218, 220 of the collet protrusion 206. In an embodiment, the surfaces 308, 310 may be disposed at generally obtuse angles with respect to the angle between the inner surface 318 of the wellbore tubular 302 and the surfaces 308, 310 as measured in a longitudinal direction (i.e., along axis X). This angle may allow for a radially compressive force to be applied to the springs 204 when the collet protrusion 206 engages the indicator 304. In an embodiment, the angle between inner surface 318 of the wellbore tubular 302 and the surfaces 308, 310 may correspond to the angle of the surfaces 218, 220 on the collet protrusion 206. In general, angle between inner surface 318 of the wellbore tubular 302 and the surfaces 308, 310 may be about 100 degrees, about 110 degrees, about 120 degrees, about 130 degrees, about 135 degrees, about 140 degrees, about 150 degrees, about 160 degrees, or about 170 degrees. The angle between the inner surface 318 of the wellbore tubular 302 and the surface 308 may be the same or different than the angle between the inner surface 318 of the wellbore tubular 302 and the surface 310. In an embodiment, the edges formed between the surfaces 308, 310 and the inner surface of the indicator 304 may be rounded or otherwise beveled to aid in the movement of the collet protrusion 206 past the indicator 304.

The collet protrusion 206 may generally have a height 312 configured to engage the indicator 304. As used herein the height 312 of the collet protrusion 206 may refer to the radial distance that the outer surface 307 of the collet protrusion 206 extends beyond the surface 306 of the corresponding spring 204. Similarly, the indicator 304 may have a height 314 sufficient to allow for an engagement with the collet protrusion 206. The interference distance 316 represents the amount of radial overlap between the collet protrusion 206 and the indicator 304, and is the amount by which the collet spring 204 must be displaced in order to allow the collet to pass by the indicator. The interference distance 316 can be chosen through a selection of the height 314 of the indicator 304 and/or the height 312 of the collet protrusion 206. As noted above, the force required to radially compress and/or radially expand the springs 204 through the interference distance 316 may be based on the properties of the springs and the interference distance 316 through which the collet is radially compressed or expanded. In an embodiment, a desired force may be achieved through a selection of the properties of the springs 204 and the interference distance 316. In an embodiment, the interference distance 316 may range from about 0.001 inches to about 0.5 inches, alternatively about 0.02 inches to about 0.2 inches, or alternatively about 0.03 inches to about 0.1 inches.

The radial compression and/or radial expansion of the springs 204 through the interference distance 316 results from the engagement of a surface (e.g., surface 308) of the indicator 304 with a surface (e.g., a surface 218) of the collet protrusion 206. At a first point 320 of engagement between the indicator 304 and the collet protrusion 206 corresponding to a first surface 218, a portion of the force resulting from the engagement between the corresponding surfaces is directed in a longitudinal direction (i.e., along axis X) and a portion of the force is directed in a radial direction. In an embodiment, the portion of the force directed along the longitudinal direction may be transferred to an actuation mechanism to actuate one or more downhole tools or components. When the longitudinal resistance of the indicator 304 rises above a threshold (e.g., when the actuation mechanism moves to an actuated state, for example reaching a stop or a maximum translation position), the radial force may also increase. As the radial force applied to the spring 204 at the first point 320 of engagement exceeds a first force required to displace the spring 204 through the interference distance 316, the collet protrusion 206 may pass by the indicator 304.

Similarly, when the collet 200 is conveyed in a second direction, a surface (e.g., surface 310) of the indicator 304 may engage a surface of the collet protrusion 206 at a second point 322 of engagement corresponding to surface 220. The longitudinal force resulting from the engagement of the indicator 304 with the collet protrusion 206 may be transferred to the actuation mechanism to actuate one or more downhole tools or components. When the longitudinal resistance of the indicator 304 rises above a threshold (e.g., when the actuation mechanism moves to an actuated state), the radial force may also increase. As the radial force applied to the spring 204 at the second point 322 of engagement exceeds a second force required to displace the spring 204 at the second point 322 through the interference distance 316, the collet protrusion 206 may pass by the indicator 304.

In an embodiment, the selection of the location of the surfaces of the collet protrusion 206, and therefore the points (e.g., the first point 320 and/or the second point 322) at which the collet protrusion 206 engages the indicator 304, may allow one force to be applied to the indicator 304 in a first direction and a different force to be applied to the indicator 304 in a second direction. As discussed above, the force required to radially compress and/or expand the spring a given distance (e.g., the interference distance 316) at a given point is generally the least at the center point and/or the load center point of the spring 204. As the point of radial compression and/or radial expansion moves away from the center point and/or load center point of the spring 204, the force required to radially compress and/or expand the spring 204 the given distance (e.g., the interference distance 316) increases. This principle may be used to configure the collet protrusion 206 to provide one force (e.g., one longitudinal force) in a first direction and a different force (e.g., a different longitudinal force) in a second direction for actuating an actuation mechanism.

In an embodiment, the second surface 220 corresponding to a second point 322 may be located at approximately a center point (e.g., the center 224 and/or load center point) of the spring 204. The first surface 218 corresponding to the first point 320 may be located a longitudinal distance 324 away from the second surface 220. As a result of this configuration, the amount of longitudinal force that can applied and/or the amount of longitudinal resistance that can be encountered prior to exceeding the radial force required to displace the spring 204 through the interference distance 316 may be higher at the first surface 218 than at the second surface 220.

In another embodiment, the first surface 218 corresponding to a first point 320 may be located at approximately a center point (e.g., the center 224 and/or load center point) of the spring 204. The second surface 220 corresponding to the second point 322 may be located a longitudinal distance 324 away from the first surface 218. As a result of this configuration, the amount of longitudinal force that can applied and/or the amount of longitudinal resistance that can be encountered prior to exceeding the radial force required to displace the spring 204 through the interference distance 316 may be higher at the second surface 220 than at the first surface 218.

In an embodiment, the distance 324 between the first surface 218 and the second surface 220 may be selected to provide a configuration and location of the collet protrusion 206 and corresponding surfaces 218, 220 requiring a lower force to radially compress and/or radially expand the springs 204 upon engagement with the indicator 304 at one surface (e.g., the first surface 218) as compared to another surface (e.g., the second surface 220). In an embodiment in which the second surface 220 is located at the center point 224 of the spring 204, the distance 324 may be at least about 10%, about 20%, about 30%, or about 40% of the overall length of the spring 204 between the first end 208 and the second end 210 of the collet 200. In an embodiment in which the first surface 218 is located at the center point 224 of the spring 204, the distance 324 may be at least about 10%, about 20%, about 30%, or about 40% of the overall length of the spring 204 between the first end 208 and the second end 210 of the collet 200.

In an embodiment, neither the first surface 218 nor the second surface 220 may be located at the center point 224 of the spring 204. A longitudinal force differential may be achieved between a first surface 218 and a second surface 220 by configuring the distance between the first surface 218 and the center point of the spring 204 to be different than the distance between the second surface 220 and the center point 224 of the spring 204. In an embodiment, the distance between the first surface 218 and the center point of the spring 204 to be less than the distance between the second surface 220 and the center point 224 of the spring 204. In an embodiment in which neither the first surface 218 nor the second surface 220 are located at the center point 224 of the beam, the ratio of the distance between the second surface 220 and the center point of the spring 204 to the distance between the first surface 218 and the center point 224 of the spring 204 may be greater than about 1.05, greater than about 1.1, greater than about 1.2, greater than about 1.3, greater than about 1.4, greater than about 1.5, greater than about 1.6, greater than about 1.7, greater than about 1.8, greater than about 1.9, or greater than about 2.0.

In an embodiment, the configuration of the locations of the surfaces (e.g., the first surface 218 and/or the second surface 220) at which the collet protrusion 206 engages the indicator 304 may allow a first longitudinal force to be applied to an actuation mechanism in a first direction and a second longitudinal force to be applied to the actuation mechanism in a second direction. In an embodiment, the first longitudinal force may be different than the second longitudinal force. In an embodiment, the first longitudinal force may be greater than the second longitudinal force, or the second longitudinal force may be greater than the first longitudinal force. In an embodiment, the collet protrusion 206 and the corresponding engagement surfaces may be configured to provide a ratio of the second longitudinal force to the first longitudinal force of greater than about 1.1, greater than about 1.2, greater than about 1.3, greater than about 1.4, greater than about 1.5, greater than about 1.6, greater than about 1.7, greater than about 1.8, greater than about 1.9, greater than about 2.0, or greater than about 2.5. In an embodiment, the first longitudinal force may range from about 1,000 pounds-force to about 10,000 pounds-force, alternatively about 2,500 pounds-force to about 7,500 pounds-force, or alternatively about 3,000 pounds-force to about 6,000 pounds-force. The second longitudinal force may range from about 2,000 pounds-force to about 20,000 pounds-force, alternatively about 5,000 pounds-force to about 15,000 pounds-force, alternatively about 7,500 pounds-force to about 12,500 pounds-force, or alternatively about 9,000 pounds-force to about 11,000 pounds-force.

In an embodiment, the first longitudinal force may be less than or equal to a compressive load limit of the wellbore tubular coupled to the collet. In an embodiment, the first longitudinal force may be less than about 99%, less than about 95%, less than about 90%, less than about 80%, or alternatively less than about 70% of the compressive load limit of the wellbore tubular coupled to the collet. In an embodiment, the second longitudinal force may be less than or equal to a tensile load limit of the wellbore tubular coupled to the collet. In an embodiment, the second force may be less than about 99%, less than about 95%, less than about 90%, less than about 80%, or alternatively less than about 70% of the tensile load limit of the wellbore tubular coupled to the collet.

Figure 4:
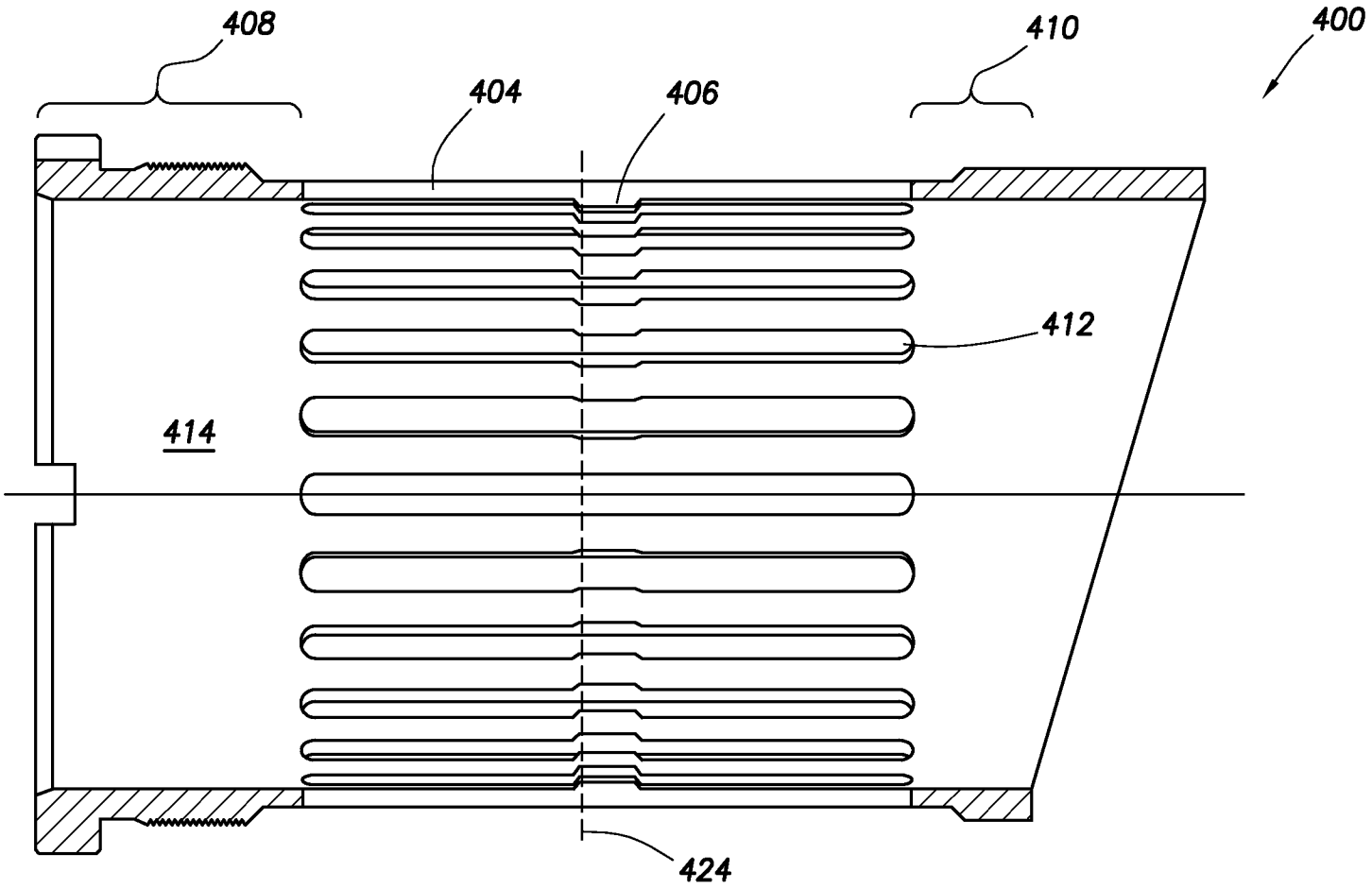
FIG. 4 is another cross-sectional view of a collet accordingly to another embodiment.
Figure 5:
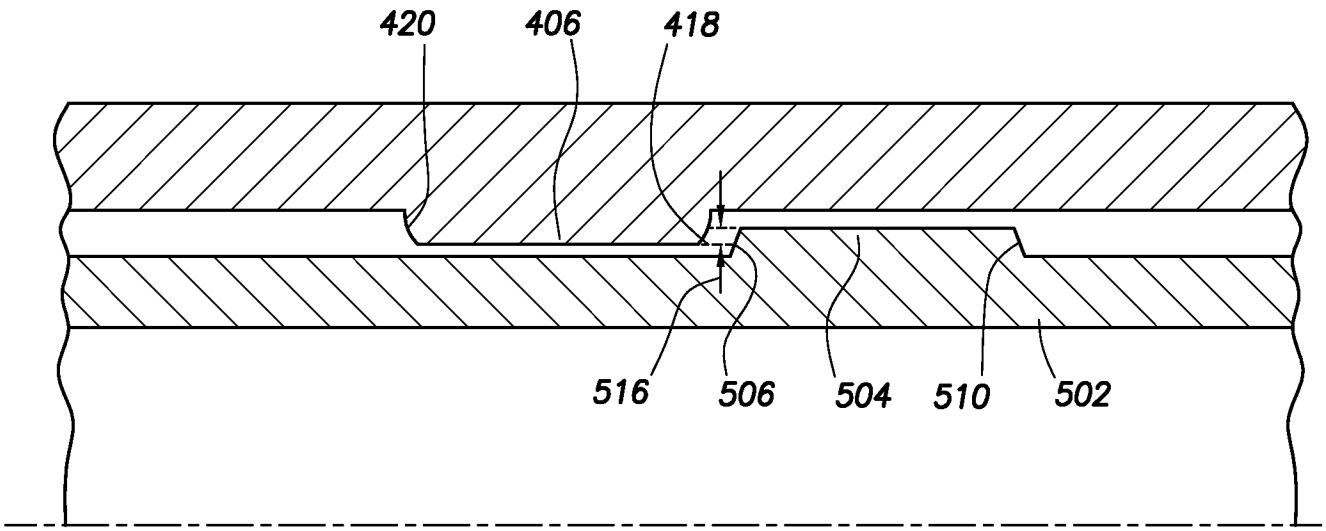
FIG. 5 is another cross-sectional view of a collet and a wellbore tubular accordingly to another embodiment.

In addition to the embodiment of the collet described with respect to FIGS. 2A, 2B, and 3, another embodiment of the collet is shown in FIGS. 4 and 5. The collet 400 illustrated in FIGS. 4 and 5 is similar to the collet 200 illustrated in FIGS. 2A, 2B, and 3, and similar components may be the same or similar to those described with respect to FIGS. 2A, 2B, and 3. The collet 400 comprises a first end 408, a second end 410, a plurality of collet springs 404 with a plurality of slots 412 disposed there between, and a longitudinal fluid passage 414 extending through the collet 400. The collet 400 also comprises a collet protrusion 406 disposed on an inner surface of the springs 404 that may interact with an indicator disposed on an outer surface of a wellbore tubular 502. Since the collet protrusion 406 is disposed on an inner surface of the springs 404, this embodiment may be referred to in some contexts as an inverted collet.

The one or more springs 404 may be configured to allow for a limited amount of radial expansion in response to a radially expansive force during the engagement of the collet protrusion 406 with one or more surfaces 506, 510 of an indicator 504. The indicator 504 may be coupled to an outer surface of a wellbore tubular 502 and/or as a part of a downhole tool or actuation mechanism. The indicator 504 is configured to engage the collet protrusion 406 to produce longitudinal and radial forces at one or more points along the springs 404. The indicator 504 and the wellbore tubular 502 are generally configured to resist radial movement and may be configured to withstand greater radial compressive loads than the springs 404 of the collet 400. As a result, the engagement between the collet protrusion 406 and the indicator 504 may produce a radial expansion of the springs 404 through an interference distance 516 rather than a radial expansion of the wellbore tubular 502 when the longitudinal resistance is above a threshold. Any of the considerations relative to configuring the location of the surfaces 418, 420 of the collet protrusion 406 relative to the center point 424 of the spring may be applied to the collet 400 to allow a downhole device to be actuated with one force in a first direction and a different force in a second direction, as was discussed previously with respect to FIGS. 2A, 2B, and 3 and collet 200.

Still another embodiment of a collet is illustrated in FIGS. 6A, 6B, 6C, and 7. The collet 600 illustrated in FIGS. 6A, 6B, 6C, and 7 is similar to the collet 200 illustrated in FIGS. 2A, 2B, and 3, and similar components may be the same or similar to those described with respect to FIGS. 2A, 2B, and 3. The collet 600 comprises a first end 608, a second end 610, a plurality of collet springs 604 with a plurality of slots 612 disposed there between, and a longitudinal fluid passage 614 extending through the collet 600. The collet 600 also comprises a collet protrusion 606 disposed on an outer surface of the springs 604 that may interact with an indicator 702 disposed on an inner surface of a wellbore tubular 702.

The collet protrusion 606 is configured to engage the indicator 704 and thereby produce a longitudinal force on the indicator 704 and a radial force (e.g., a radially compressive force) on the springs 604. In an embodiment, the collet protrusion 606 may be configured to engage the indicator 704 at any of a plurality of surfaces and thereby produce the corresponding longitudinal and radial forces at a plurality of points along the length of the springs 604. The configuration of the collet protrusion 606 may be used to determine the longitudinal force applied to the indicator 704 and the radial force required to move the collet 600 past the indicator 704 in each direction.

As shown in FIGS. 6A, 6B, 6C, and 7, the collet protrusion 206 generally comprises a section of the springs 604 with an increased outer diameter. The collet protrusion 606 may comprise two raised portions 622, 624 having an increased outer diameter and a central portion 626 having an increased outer diameter relative to the outer surface of the springs 604, and an outer diameter that may be less than the two portions 622, 624 (e.g., forming a protrusion having a recessed central portion). In an embodiment, the outer diameter of the central portion 626 may be configured to allow the indicator 704 to pass by the central portion 626 without engaging the central portion 626. The collet protrusion 606 may comprise one or more surfaces 618, 620, 726, 728 for contacting an indicator 704 disposed on an outer wellbore tubular 702 through which the collet 600 passes. In an embodiment, the surfaces 726, 728 may be disposed at generally obtuse angles with respect to the angle between the outer surface 706 of the springs 604 and the surfaces 726, 728 as measured in a longitudinal direction. The angles of the surfaces 726, 728 may be selected to allow the indicator 704 to pass over the surfaces 726, 728 without producing a longitudinal force sufficient to actuate an actuation mechanism. In an embodiment, the an the angle between the outer surface 706 of the springs 604 and the surfaces 726, 728 as measured in a longitudinal direction may range from about 120 degrees to about 150 degrees. The angles of the surfaces 726, 728 may each be the same or they may be different.

In an embodiment, the surfaces 618, 620 may be disposed at generally obtuse angles with respect to the angle between the outer surface of the central portion 626 and the surfaces 618, 620 as measured in a longitudinal direction. In an embodiment, the angle between the outer surface of the central portion 626 and the surfaces 618, 620 as measured in a longitudinal direction may range from great than about 90 degrees to about 120 degrees. The angles of the surfaces 618, 620 may each be the same or they may be different. This angle may allow for a longitudinal force to be applied to the indicator 704 and a radially compressive force to be applied to the springs 604 when the surfaces 618, 620 of the respective raised portions 624, 622 contacts the corresponding surface 708, 710 of the indicator 704 on the outer wellbore tubular 702. In an embodiment, the edges formed between the surfaces 618, 620 and the outer surface of the corresponding raised portions 624, 622 may be rounded or otherwise beveled to aid in the movement of the collet protrusion 606 past the indicator 704.

The radial compression of the springs 604 through the interference distance 716 results from the engagement of a surface 708, 710 of the indicator 704 with a surface 618, 620, 726, 728 of the collet protrusion 606. At a point of engagement between a surface 708, 710 of the indicator 704 and a surface 618, 620, 726, 728 of the collet protrusion 606, a portion of the resulting force between the corresponding surfaces is directed in a longitudinal direction and a portion of the force is directed in a radial direction. The portion of the force directed in the longitudinal and radial directions is based, at least in part, on the angle of the surfaces. In general, as the angle between the outer surface 706 of the springs 604 and the surfaces 618, 620, 726, 728 increases, a greater portion of the force is directed in the radial direction and less of the force is directed in the longitudinal direction. In an embodiment, the angle between the outer surface 706 of the springs 604 and the surfaces 726, 728 may be selected so that the radially directed portion of the force resulting from the engagement of the collet 600 with the indicator 704 is sufficient to radially compress the springs 604 through the interference distance 716 rather than actuate an actuation mechanism in a longitudinal direction. This may allow the indicator 704 to pass into radial alignment with the central portion 626 of the collet protrusion 606 prior to actuation of an actuation mechanism.

In an embodiment, the angle between the outer surface of the central portion 626 and the surfaces 618, 620 may be selected so that the engagement between the surfaces 618, 620 and the indicator 704 may produce a sufficient portion of the force directed in the longitudinal direction to actuate an actuation mechanism coupled to one or more downhole tools or components. When the longitudinal resistance of the indicator 704 rises above a threshold (e.g., when the actuation mechanism moves to an actuated state), the radial force applied to the spring 604 at the corresponding point 720, 722 of engagement may exceed the radial force required to displace the spring 604 through the interference distance 716. The corresponding raised portion 622, 624 of the collet protrusion 606 may then pass by the indicator 704. In an embodiment, the selection of the location of the surfaces 618, 620 of the collet protrusion 606, and therefore the points (e.g., the first point 720 and/or the second point 722) at which the collet protrusion 606 engages the indicator 704, may allow a one longitudinal force to be applied to the actuation mechanism in a first direction and a different longitudinal force to be applied to the actuation mechanism in a second direction. Any of the considerations and resulting force differentials discussed with respect the collet 200 also apply to the selection of the locations of the surfaces 618, 620 of the collet 600.

Returning to FIGS. 2A, 2B, and 3, the indicator 304 may form a portion of an actuation mechanism for actuating a downhole tool or component. The actuation mechanism may generally be configured to produce a movement in a downhole tool through a translation of one or more components of the actuation mechanism. As discussed above, the translation may be a longitudinal translation and may be achieved through the engagement of the indicator with one or more surfaces of the collet protrusion 206. The surfaces 218, 220 of the collet 200 may be configured to provide one longitudinal force to actuate an actuation mechanism in a first direction and a different longitudinal force to actuate the actuation mechanism in a second direction. The corresponding actuation mechanism may be configured to actuate in response to one longitudinal force in a first direction and the different longitudinal force in the second direction. Any of a variety of actuation mechanisms comprising a feature configured to act as an indicator 304 may be used with the collet disclosed herein. In an embodiment, the actuation mechanisms may be coupled to and configured to actuate one or more devices including, but not limited to, a plug, a valve (e.g., a lubricator valve, tubing retrievable safety valve, fluid loss valves, etc.), a flow control device (e.g., a shifting sleeve, a selective flow device, etc.), a zonal isolation device (e.g., a plug, a packer such as a production packer, gravel pack packer, frac-pac packer, etc.), a sampling device, a portion of a drilling completion, a portion of a completion assembly, and any other downhole tool or component that is configured to be mechanically actuated by the translation of one or more components.

Figure 8:
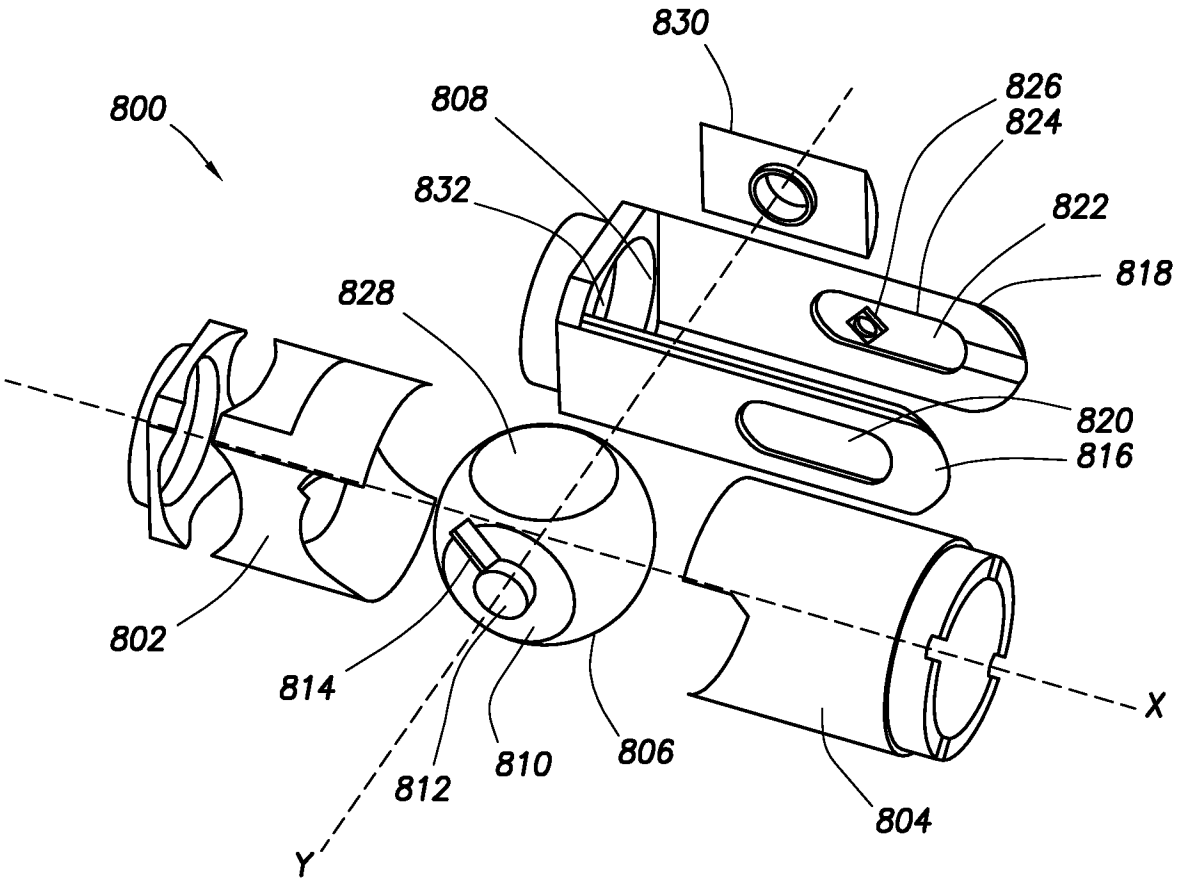
FIG. 8 is an exploded isometric view of an embodiment of a ball valve.

In an embodiment, the actuation mechanism may be coupled to a valve such as a ball valve. As shown in FIG. 8, an embodiment of a ball valve 800 may generally comprise a variety of components to provide a seal (e.g., a ball/seat interface) and an actuation mechanism to actuate the ball valve 800. While an exemplary actuation mechanism and process is described with respect to a ball valve assembly, it is expressly understood that the actuation mechanism providing the longitudinal translation may be used with any of a variety of downhole tools.

In an embodiment, the ball valve 800 assembly may comprise two cylindrical retaining members 802, 804 on opposite sides of the ball 806. One or more seats or seating surfaces may be disposed above and/or below the ball 806 (e.g., within or engaging cylindrical retaining member 802 and/or cylindrical retaining member 804) to provide a fluid seal with the ball 806. The ball 806 generally comprises a truncated sphere having planar surfaces 810 on opposite sides of the sphere. Planar surfaces 810 may each have a projection 812 (e.g., cylindrical projections) extending outwardly therefrom, and a radial groove 814 extending from the projection 812 to the edge of the planar surface 810.

An actuation mechanism may comprise or may be coupled to an actuation member 808 having two parallel arms 816, 818 that are positioned about the ball 806 and the retaining members 802, 804. In an embodiment, the actuation member 808 may comprise an indicator 832 disposed on the upper side of the ball 806. In some embodiments, the actuation member 808 may be coupled to a separate actuation mechanism comprising an indicator on the upper side of the ball 806. The actuation member 808 may be aligned such that arms 816, 818 are in a plane parallel to that of planar surfaces 810. Projections 812 may be received in windows 820, 822 through each of the arms 816, 818. Actuation pins 824 may be provided on each of the inner sides of the arms 816, 818. Pins 824 may be received within the grooves 814 on the ball 806. Bearings 826 may be positioned between each pin 824 and groove 814, and a support member 830 may engage a projection 812 within the respective windows 820, 822.

In the open position, the ball 806 is positioned so as to allow flow of fluid through the ball valve 800 by allowing fluid to flow through an interior fluid passageway 828 (e.g., a bore or hole) extending through the ball 806. During operation, the ball 806 is rotated about rotational axis Y such that interior flow passage 828 is rotated out of alignment with the flow of fluid, thereby forming a fluid seal with one or more seats or seating surfaces and closing the valve. The interior flow passage 828 may have its longitudinal axis disposed at about 90 degrees to the axis X when the ball is in the closed position and the longitudinal axis may be aligned with the axis X when the ball is in the open position. The ball 806 may be rotated by longitudinal movement of the actuation member 808 along axis X. The pins 824 move as the actuation member 808 moves, which causes the ball 806 to rotate due to the positioning of the pins 824 within the grooves 814 on the ball 806.

With reference to FIGS. 1 and 8, the ball valve 800 and its associated components can be disposed within a wellbore 114 as a portion of the wellbore tubular string 120. In an embodiment, the ball valve 800 may comprise a sub-surface safety valve, a fluid loss valve, and/or a lubricator valve. In order to actuate the ball valve 800 from a closed position to an open position, a second wellbore tubular string 122 comprising a collet 200 as described herein may be disposed within the wellbore tubular string 120 comprising the ball valve 800. As the second wellbore tubular string 122 is conveyed within the wellbore tubular string 120, the collet 200 may be conveyed into proximity with the indicator 832 of the ball valve.

As shown in FIG. 3, the indicator 832 on the actuation member 808 may represent the indicator 304 with the upper portion of the wellbore on the left side of FIG. 3. As the collet 200 approaches the indicator 304 from the upper side of the ball valve 800, the surface 220 of the collet protrusion 206 may engage the surface 310 of the indicator 304 at a corresponding point 320. A force may be applied to the collet 200 to the point of engagement through the second wellbore tubular 122 from the surface of the wellbore 114. A portion of this force is directed in a longitudinal direction (i.e., along axis X) and a portion of the force is directed in a radial direction. In an embodiment, the longitudinal portion of the force may be transferred to an actuation member 808 to actuate the ball valve 800. As this first force is applied in the longitudinal direction, the actuation member 808 may move down along the axis X. The pins 824 move as the actuation member 808 moves along the axis X, which causes the ball 806 to rotate due to the positioning of the pins 824 within the grooves 814 on the ball 806. The actuation member 808 may move down until the upper surface of the windows 820, 822 contacts the edge of the protrusions on the support member 830 to rotate the ball 806 to the open position. At this point, the actuation member 808 may be constrained from further downward movement and the longitudinal resistance may be characterized as exceeding a threshold. Subsequent force applied to the collet 200 through the second wellbore tubular 122 may result in the radial force applied to the spring 204 at the point 322 of engagement exceeding a force required to displace the spring 204 through the interference distance 316, thereby allowing the collet protrusion 206 to pass by the indicator 304. The second wellbore tubular 122 comprising the collet 200 may then be conveyed through the interior fluid passageway 828 of the ball 806, which may allow for one or more fluids to be produced from the wellbore and/or a wellbore servicing fluid to be pumped into the wellbore formation (e.g., from a zone located below the ball valve) through the second wellbore tubular 122.

Upon conveying the second wellbore tubular 122 out of the wellbore 114, the collet may pass through the interior fluid passageway 828 of the ball 806 and engage the lower side of the indicator 832. Again referring to the indicator 304 illustrated in FIG. 3 as representing the indicator 832, a surface 308 of the indicator 304 may engage a surface 218 of the collet protrusion 206 at a point 320 of engagement corresponding to surface 218. The longitudinal force resulting from the engagement of the indicator 304 with the collet protrusion 206 may be transferred to the actuation member 808 of the ball valve 800. Due to the configuration of the surface 218, the longitudinal force applied to the actuation member 808 is different than the longitudinal force applied to open the ball valve 800. As this second longitudinal force is applied to the indicator 304, the actuation member 808 may move up along the axis X. The pins 824 move as the actuation member 808 moves along the axis X, which causes the ball 806 to rotate due to the positioning of the pins 824 within the grooves 814 on the ball 806. The actuation member 808 may move up until the lower surface of the windows 820, 822 contacts the edge of the protrusions on the support member 830 to the closed position (e.g., closing the ball valve 800 and shutting in the well below the valve). At this point, the actuation member 808 may be constrained from further upward movement and the longitudinal resistance may be characterized as exceeding a threshold. Subsequent force applied to the collet 200 through the second wellbore tubular 122 may result in the radial force applied to the spring 204 at the point 320 of engagement exceeding a force required to displace the spring 204 through the interference distance 316, thereby allowing the collet protrusion 206 to pass by the indicator 304. The second wellbore tubular 122 comprising the collet 200 may then be conveyed within the wellbore tubular 120 above the ball valve 800. For example, the second wellbore tubular 122 may then be safely removed from the wellbore while the lower portion of the wellbore may be shut in via the closed ball valve 800.

In this embodiment, the collet, including the surfaces of the collet protrusion, may be configured so that the first force applied to the actuation mechanism to actuate the ball valve 800 to an open position and pass the second wellbore tubular 122 through the ball valve 800 may be less than the second force applied to the actuation mechanism to actuate the ball valve 800 to a closed position. In an embodiment, the second wellbore tubular 122 may comprise coiled tubing, and the first force applied to the actuation mechanism to actuate the ball valve 800 to an open position may be less than the buckling limit (i.e., a compressive force threshold) of the coiled tubing. In this embodiment, the second force applied to the actuation mechanism to actuate the ball valve 800 to a closed position may be greater than the first force and below the tensile force limit of the coiled tubing.

The collet described herein may allow for the use of differential forces to be applied to actuate a downhole tool in different directions. The use of differential forces may allow for various wellbore tubulars to be used for actuating downhole tools that have a different tensile and compressive load limits, such as coiled tubing and the like. The ability to apply different forces in different directions may also be used to actuate downhole tools having differential opening and closing loads. Further, the collet described herein achieves the differential applied forces based on the configuration of the engagement surfaces of the collet protrusion being located at different points along the springs of the collet. While the angle of the engagement surfaces may alter the amount of longitudinal force and radial force applied to an actuation mechanism, this technique may only allow for a limited and unpredictable amount of force differential when the interference distance is small. The use of varying engagement points may advantageously produce a more predictable and consistent interaction between the collet and an actuation mechanism.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A downhole actuation system comprising:

an actuation mechanism comprising an indicator, wherein the indicator comprises two opposing surfaces;

a wellbore tubular; and a collet coupled to the wellbore tubular, wherein the collet comprises a collet protrusion disposed on one or more collet springs, wherein the collet protrusion comprises a first engagement surface for contacting the first surface of the indicator and a second engagement surface for contacting the second surface of the indicator;

wherein the collet protrusion has a position on the one or more collet springs that is configured to provide a first longitudinal force from the first engagement surface to the first surface of the indicator in a first direction and a second longitudinal force from the second engagement surface to the second surface of the indicator in a second direction, and wherein the first longitudinal force is different than the second longitudinal force.

2. The system of claim 1, wherein the wellbore tubular comprises a drill pipe, a casing, a liner, a jointed tubing, a coiled tubing, or any combination thereof.

3. The system of claim 1, wherein a ratio of the second longitudinal force to the first longitudinal force is greater than about 1.1.

4. The system of claim 1, wherein the first longitudinal force is in the range of from about 1,000 pounds-force to about 10,000 pounds-force.

5. The system of claim 4, wherein the second longitudinal force is in the range of from about 2,000 pounds-force to about 20,000 pounds-force.

6. The system of claim 1, wherein the first longitudinal force is less than a compressive load limit of the wellbore tubular.

7. The system of claim 1, wherein the second longitudinal force is less than a tensile load limit of the wellbore tubular.

8. The system of claim 1, further comprising a downhole tool coupled to the actuation mechanism, wherein the actuation mechanism is configured to produce a movement in the downhole tool through a translation of one or more components of the actuation mechanism.

9. The system of claim 8, wherein the downhole tool comprises a device selected from the group consisting of: a plug, a valve, a lubricator valve, a tubing retrievable safety valve, a fluid loss valve, a flow control device, a zonal isolation device, a sampling device, a portion of a drilling completion, a portion of a completion assembly, and any combination thereof.

10. The system of claim 1, wherein the actuation mechanism is configured to actuate a downhole tool to a first position in response to the first longitudinal force in the first direction, and wherein the actuation mechanism is further configured to actuate the downhole tool to a second position in response to second longitudinal force in the second direction.

11. A collet comprising:

a collet spring; and a collet protrusion disposed on the collet spring for engaging an indicator of an actuation mechanism, wherein the collet protrusion comprises a first engagement surface for engaging a first surface of the indicator and a second engagement surface for engaging a second surface of the indicator opposite the first surface, and wherein a first distance between the first engagement surface and a center point of the collet spring is less than a second distance between the second engagement surface and the center point of the spring, such that the collet protrusion is configured to apply a first longitudinal force from the first engagement surface to the first surface of the indicator in a first direction and to apply a second longitudinal force from the second engagement surface to the second surface of the indicator in a second direction, wherein the first longitudinal force is different from the second longitudinal force.

12. The collet of claim 11, further comprising a plurality of collet springs and a plurality of slots disposed between adjacent collet springs, wherein the plurality of collet springs couples a first end to a second end.

13. The collet of claim 12, wherein the first end or the second end comprises a tapered guide.

14. The collet of claim 11, wherein the center point of the collet spring comprises a center of the collet spring or a load center point of the collet spring.

15. The collet of claim 11, wherein the first engagement surface is located at about the center point of the collet spring.

16. The collet of claim 15, wherein the second distance is at least about 10% of an overall length of the collet spring.

17. The collet of claim 11, wherein neither the first distance nor the second distance is zero, and wherein a ratio of the second distance to the first distance is greater than about 1.05.

18. The collet of claim 11, wherein the collet protrusion is disposed on an inner surface of the collet spring.

19. The collet of claim 11, wherein the collet protrusion is disposed on an outer surface of the collet spring.

20. The collet of claim 11, wherein the collet protrusion is disposed on the collet spring to facilitate passing the collet by the actuation mechanism by radially displacing the collet spring through an interference distance and conveying the collet past the indicator in response to a radial force applied to the collet protrusion at the first engagement surface upon the first longitudinal force exceeding a threshold.

21. A method of actuating a downhole tool comprising:

providing a collet coupled to a wellbore tubular, wherein the collet comprises a collet protrusion disposed on a collet spring;

providing a first longitudinal force to an actuation mechanism in a first direction using the collet by engaging a first surface of the collet with an indicator coupled to the actuation mechanism;

passing the collet by the actuation mechanism in response to the first longitudinal force exceeding a threshold by applying a radial force to the collet protrusion at the first surface, radially displacing the collet spring through an interference distance, and conveying the collet past the indicator; and providing a second longitudinal force to the actuation mechanism in a second direction using the collet, wherein the first longitudinal force is different that the second longitudinal force, and wherein the first longitudinal force and the second longitudinal force are provided as a result of the configuration of the placement of the collet protrusion on the collet spring.

22. The method of claim 21, wherein the actuation mechanism is configured to actuate a downhole tool to a first position in response to the first longitudinal force in the first direction, and wherein the actuation mechanism is further configured to actuate the downhole tool to a second position in response to second longitudinal force in the second direction.

23. The method of claim 22, wherein the downhole tool comprises a device selected from the group consisting of: a plug, a valve, a lubricator valve, a tubing retrievable safety valve, a fluid loss valve, a flow control device, a zonal isolation device, a sampling device, a portion of a drilling completion, a portion of a completion assembly, and any combination thereof.

* * * * *